US010276904B2

(12) United States Patent
Zhang et al.

(10) Patent No.: US 10,276,904 B2
(45) Date of Patent: Apr. 30, 2019

(54) RESONANT UNIT AND FILTER

(71) Applicant: Huawei Technologies Co., Ltd., Shenzhen (CN)

(72) Inventors: Zeming Zhang, Chengdu (CN); Huizhen Qian, Chengdu (CN); Xun Luo, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 74 days.

(21) Appl. No.: 15/625,374

(22) Filed: Jun. 16, 2017

(65) Prior Publication Data

US 2017/0365903 A1 Dec. 21, 2017

(30) Foreign Application Priority Data

Jun. 16, 2016 (CN) ..... 2016 1 0428290

(51) Int. Cl.

*H01P 1/203* (2006.01)
*H01P 7/08* (2006.01)
*H01P 3/08* (2006.01)

(52) U.S. Cl.

CPC ..... *H01P 1/203* (2013.01); *H01P 1/20327* (2013.01); *H01P 1/20336* (2013.01); *H01P 3/08* (2013.01); *H01P 7/08* (2013.01); *H01P 7/082* (2013.01)

(58) Field of Classification Search

CPC .... H01P 1/203; H01P 3/08; H01P 7/08; H01P 7/082; H01P 1/20336; H01P 1/20327
USPC ..... 333/204, 238, 246
See application file for complete search history.

(56) References Cited

U.S. PATENT DOCUMENTS

2017/0194682 A1 7/2017 Su

FOREIGN PATENT DOCUMENTS

| | | | |
|---|---|---|---|
| CN | 202550038 | U | 11/2012 |
| CN | 103545584 | A | 1/2014 |
| CN | 105680126 | A | 6/2016 |
| EP | 1170817 | A1 | 1/2002 |
| KR | 20050060279 | A | 6/2005 |
| KR | 20100131155 | A | 12/2010 |

OTHER PUBLICATIONS

Machine Translation and Abstract of Korean Publication No. KR2010013155, dated Dec. 15, 2010, 24 pages.

(Continued)

*Primary Examiner* — Rakesh B Patel
(74) *Attorney, Agent, or Firm* — Conley Rose, P.C.

(57) ABSTRACT

A resonant unit and a filter, where the resonant unit includes a dielectric substrate, a metal microstrip disposed on a plane of the dielectric substrate, where the metal microstrip is used as a signal input/output port, and a defected ground structure disposed on another plane opposite to the plane of the dielectric substrate, where the defected ground structure includes a ground loop and an interdigital structure located inside the ground loop, the interdigital structure includes multiple fingers, and the ground loop or at least one finger in the interdigital structure includes at least one embedded interdigital structure. Harmonic suppression capabilities of the resonant unit and the filter can be improved, and an area can be reduced.

20 Claims, 12 Drawing Sheets

(56) References Cited

OTHER PUBLICATIONS

Balalem, A., et al., "Quasi-Elliptic Microstrip Low-Pass Filters Using an Interdigital DGS Slot," XP011189451, IEEE Microwave and Wireless Components Letters, IEEE Service Center, vol. 17, No. 8, Aug. 2007, 3 pages.
Xun L., et al., "Hybrid Microstrip T-Stub/Defected Ground Structure Cell for Electromagnetic Interference Bandpass Filter Design," XP011476876, IEEE Transactions on Electromagnetic Compatibility, vol. 53, No. 3, Aug. 2011, pp. 717-725.
Verma, A. K., et al., "Design of low-pass filters using some defected ground structures," XP028098258, AEU-International Journal of Electronics and Communications, Elsevier, Amsterdam, NL, vol. 65, No. 10, Feb. 11, 2011, 9 pages.
Yuan, L., et al., "A Microstrip Line Bases on Interdigital Defected Ground Structure," XP031266709, Global Symposium on Millimeter Waves, Apr. 21, 2008, 4 pages.
Zhang, Z., et al."Dual-Band Bandpass Filter Based on Slow-Wave Resonant Cell with Dual-Resonance," XP032956743, IEEE MTT-S International Conference on Numerical Electromagnetic and Multiphysics Modeling and Optimization (NEMO), Jul. 27, 2016, 2 pages.
Foreign Communication From a Counterpart Application, European Application No. 17175812.1, Extended European Search Report dated Nov. 15, 2017, 11 pages.
Machine Translation and Abstract of Chinese Publication No. CN103545584, Jan. 29, 2014, 6 pages.
Machine Translation and Abstract of Chinese Publication No. CN202550038, Nov. 21, 2012, 5 pages.
Machine Translation and Abstract of Korean Publication No. KR20050060279, Jun. 22, 2005, 7 pages.
Gadhvi, D., et al., "Elliptic Low Pass Filter Design using DGS Slot for Microstrip Lines," Nirma University International Conference on Engineering (NUiCONE), 2013, 4 pages.
Foreign Communication From a Counterpart Application, Chinese Application No. 201610428290.9, Chinese Office Action dated May 3, 2018, 4 pages.
Foreign Communication From a Counterpart Application, Chinese Application No. 201610428290.9, Chinese Search Report dated Apr. 23, 2018, 3 pages.
Lan, S., et al., "A Tri-Band Bandpass Filter With Wide Stopband Using Asymmetric Stub-Loaded Resonators," IEEE Microwave and Wireless Components Letters, vol. 25, No. 1, Jan. 2015, pp. 19-21.
Shi, J., et al., "Dual-Band Bandpass Filter With Wide Stopband Using One Stepped-Impedance Ring Resonator With Shorted Stubs," IEEE Microwave and Wireless Components Letters, vol. 24, No. 7, Jul. 2014, pp. 442-444.

100

RESONANT UNIT AND FILTER

CROSS-REFERENCE TO RELATED APPLICATIONS

This application claims priority to Chinese Patent Application No. 201610428290.9 filed on Jun. 16, 2016, which is hereby incorporated by reference in its entirety.

TECHNICAL FIELD

The present disclosure relates to the communications field, and in particular, to a resonant unit and a filter.

BACKGROUND

With development of modern communications technologies, more communications standards emerge, and consequently, a signal of a communications standard interferes with a signal of another communications standard. This requires that a modern communications system should have a strong capability of suppressing an out-band signal. Based on the foregoing requirement, a filter having a desirable out-band suppression function is urgently required. In other approaches, many filters suppress a high-order harmonic wave in a base frequency signal by adding a transmission zero. In addition, some filters generate a wide stopband using a stepped impedance resonator (SIR). However, areas of the filters are large, and harmonic suppression capabilities of the filters also need to be improved.

SUMMARY

The present disclosure provides a resonant unit and a filter to improve harmonic suppression capabilities of the resonant unit and the filter.

According to a first aspect, a resonant unit is provided and includes a dielectric substrate, a metal microstrip disposed on a plane of the dielectric substrate, where the metal microstrip is used as a signal input/output port, and a defected ground structure disposed on another plane opposite to the plane of the dielectric substrate, where the defected ground structure includes a ground loop and an interdigital structure located inside the ground loop, the interdigital structure includes multiple fingers, and the ground loop and/or at least one finger in the interdigital structure includes at least one embedded interdigital structure.

The embedded interdigital structure is disposed in the defected ground structure of the resonant unit. In this way, a harmonic suppression capability of the resonant unit is improved, and an area of the resonant unit is reduced.

In a possible design, each embedded interdigital structure in the at least one embedded interdigital structure is used to introduce a resonant frequency of the resonant unit.

The embedded interdigital structure disposed in the defected ground structure of the resonant unit may introduce a new resonant frequency, and a resonant unit having multiple resonant points is formed. The resonant unit having multiple resonant points has an ultra wide out-band harmonic suppression capability. In addition, an area occupied by the resonant unit is small.

In a possible design, a value of the resonant frequency is determined by at least one of the parameters, a quantity of fingers in each embedded interdigital structure, a width of a finger in each embedded interdigital structure, or a length of a finger in each embedded interdigital structure.

In a possible design, the multiple fingers are three fingers, and at least a part of the at least one embedded interdigital structure is located on at least one finger in the three fingers.

In a possible design, the multiple fingers are two fingers, and at least a part of the at least one embedded interdigital structure is located on at least one finger in the two fingers.

In a possible design, the metal microstrip is a T-shaped microstrip, and a T-shaped vertical end of the T-shaped microstrip is used as the input/output port.

In a possible design, a projection of a T-shaped horizontal end of the T-shaped microstrip on the plane overlaps at least a part of the multiple fingers, and a projection of the T-shaped vertical end on the plane overlaps one finger in the multiple fingers.

In a possible design, the projection of the T-shaped horizontal end on the plane overlaps all of the multiple fingers.

According to a second aspect, a filter is provided and includes at least two resonant units according to the first aspect, where the at least two resonant units are cascaded.

An embedded interdigital structure is disposed in a defected ground structure of a resonant unit in the filter. In this way, a harmonic suppression capability of the resonant unit is improved, and an area of the resonant unit is reduced. Therefore, the filter including the resonant unit can improve an out-band suppression capability of the filter and reduce an area of the filter.

In a possible design, the at least two resonant units are cascaded in at least one of the manners, through-hole cascading, electric coupling cascading, or magnetic coupling cascading.

In a possible design, each resonant unit in the at least two resonant units has a same structure.

In a possible design, the filter is a band-stop filter, where at least one embedded interdigital structure is disposed directly below a metal microstrip.

In a possible design, the filter is a band-pass filter, where each of embedded interdigital structures is disposed on an area that is not directly below the metal microstrip.

Optionally, an area using a central axis of a projection of the metal microstrip on the other plane as a symmetry axis is directly below the metal microstrip.

According to a third aspect, a component is provided and includes the resonant unit according to the first aspect. The component is a duplexer, a power splitter, an antenna, a feeding network, a phase shifter, or an active circuit.

According to a fourth aspect, a semiconductor chip is provided, where the semiconductor chip is integrated with a semiconductor substrate, and includes the resonant unit according to the first aspect, or the filter according to the second aspect, or the component according to the third aspect.

BRIEF DESCRIPTION OF DRAWINGS

To describe the technical solutions in the embodiments of the present disclosure more clearly, the following briefly describes the accompanying drawings required for describing the embodiments. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. The described embodiments are a part rather than all of the embodiments of the present disclosure. All other embodiments obtained by a person of ordinary skill in the art based on the embodiments of the present disclosure without creative efforts shall fall within the protection scope of the present disclosure.

It should be understood that, the technical solutions of the embodiments of the present disclosure may be applied to various communications systems, such as a Global System of Mobile Communications (GSM) system, a Code Division Multiple Access (CDMA) system, a Wideband Code Division Multiple Access (WCDMA) system, a general packet radio service (GPRS), a Long Term Evolution (LTE) system, an LTE frequency division duplex (FDD) system, an LTE time division duplex (TDD), a Universal Mobile Telecommunications System (UMTS), a Worldwide Interoperability for Microwave Access (WIMAX) communications system, a millimeter wave communications system, a terahertz (THz) communications field, or the like.

It should be understood that, a resonant unit in an embodiment of the present disclosure may be applied to various fields, for example, may be applied to components such as a filter, a duplexer, a power splitter, an antenna, a feeding network, a phase shifter, and an active circuit. This embodiment further provides a semiconductor chip, where the semiconductor chip is integrated with a semiconductor substrate, and includes the resonant unit or any one of the foregoing components. For example, the semiconductor chip may be implemented using a Complementary metal-oxide-semiconductor (CMOS) process.

As mentioned above, in a modern communications system, a filter having a desirable out-band suppression function is urgently required. A slow-wave effect is a physical characteristic. The slow-wave effect can push a high-order harmonic wave in a base frequency signal of a filter to a higher frequency such that a desirable harmonic suppression function and a wide stopband are implemented. In addition, the slow-wave effect can also reduce an area of the filter, and reduce filter costs while implementing miniaturization. A defected ground structure is a typical structure that has a slow-wave effect.

Figure 1A:
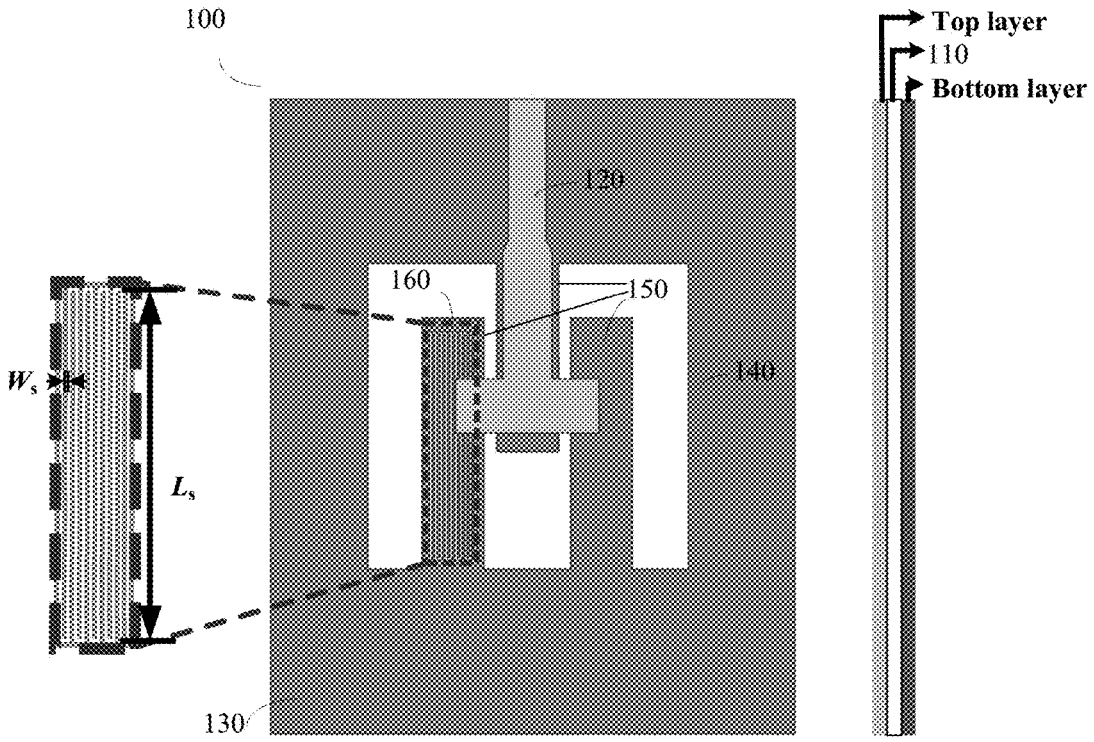
FIG. 1A is a schematic structural diagram of a resonant unit according to an embodiment of the present disclosure.
Figure 1B:
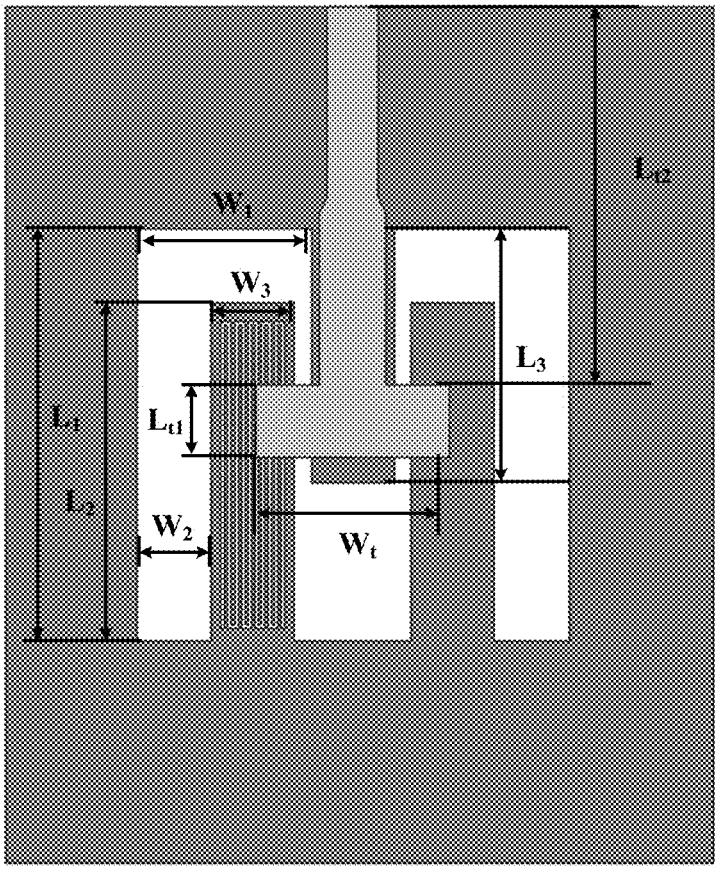
FIG. 1B is a schematic structural diagram of a resonant unit according to an embodiment of the present disclosure.

Based on this, an embodiment of the present disclosure provides a resonant unit and a filter. FIG. 1A and FIG. 1B show a schematic structure of a resonant unit 100 according to an embodiment of the present disclosure. As shown in FIG. 1A, the resonant unit 100 includes a dielectric substrate 110, as shown in a side view on a right side in FIG. 1A, a metal microstrip 120 disposed on a side of the dielectric substrate 110, and a defected ground structure 130 disposed on another side of the dielectric substrate 110, where the defected ground structure 130 includes a ground loop 140 and an interdigital structure 150 located inside the ground loop 140, the interdigital structure 150 includes multiple fingers, and the ground loop 140 and/or at least one finger in the interdigital structure 150 includes at least one embedded interdigital structure 160.

In this embodiment of the present disclosure, an embedded interdigital structure 160 is introduced in a defected ground structure 130 in a resonant unit 100. Therefore, a high-order harmonic wave in a base frequency signal is pushed to a higher frequency, a harmonic suppression capability of the resonant unit 100 is improved, the resonant unit 100 has a wide stopband with higher suppression, and an area of the resonant unit 100 is reduced.

A filter provided by an embodiment of the present disclosure includes at least two resonant units 100 described above. The filter including the resonant units 100 can improve an out-band suppression capability of the filter and reduce an area of the filter.

In addition, each embedded interdigital structure 160 in the at least one embedded interdigital structure 160 may introduce a resonant frequency of the resonant unit 100. Therefore, the embedded interdigital structure 160 disposed in the defected ground structure 130 of the resonant unit 100 introduces a new resonant frequency, and a resonant unit 100 having multiple resonant points is formed. The resonant unit 100 having multiple resonant points has an ultra wide out-band harmonic suppression capability. In addition, an area occupied by the resonant unit 100 is small.

Optionally, as shown in FIG. 1A and FIG. 1B, the metal microstrip 120 may be a T-shaped microstrip. A T-shaped vertical end of the T-shaped microstrip may be used as a signal input/output port. The metal microstrip 120 may also be in other shapes, and this is not limited in this embodiment of the present disclosure.

Optionally, a projection of a T-shaped horizontal end of the T-shaped microstrip on a plane of the dielectric substrate 110 may overlap at least a part of the multiple fingers of the interdigital structure 150, and a projection of the T-shaped vertical end on the plane overlaps one finger in the multiple fingers of the interdigital structure 150. For details, refer to FIG. 1A and FIG. 1B. The projection of the T-shaped horizontal end of the T-shaped microstrip on the plane may overlap all of the multiple fingers of the interdigital structure 150.

Optionally, a shape of the ground loop 140 in this embodiment of the present disclosure is not limited. For example, the ground loop 140 may be rectangular. As shown in FIG. 1A, the interdigital structure 150 may include multiple fingers, one end of any finger in the multiple fingers may be connected to the ground loop 140, and the other end of the any finger may be an open end. The open end is not connected to the ground loop 140. The at least one embedded interdigital structure 160 may be located on a finger of the interdigital structure 150, and/or located on the ground loop 140. In other words, the at least one embedded interdigital structure 160 may be located in any position in the defected ground structure 130.

Optionally, the interdigital structure 150 may introduce a resonant frequency of the resonant unit 100, and this resonant frequency may be referred to as a first base frequency ($f_{01}$). A value of the $f_{01}$ may be determined by at least one of the parameters a length or a width of a finger included in the interdigital structure 150, or a distance between a finger and the ground loop 140. For example, as shown in FIG. 1B, the $f_{01}$ may be reduced by increasing lengths of $L_1$, $L_2$, $L_3$, $W_1$, $W_2$, and $W_3$. The ground loop 140 in FIG. 1B is a rectangular ground loop, $L_1$ indicates a length of a side of the rectangular ground loop 140, $L_2$ and $L_3$ indicate lengths of fingers included in the interdigital structure 150, and the finger of the length $L_2$ and the finger of the length $L_3$ are cross-arranged. $W_1$ and $W_2$ indicate distances between each finger and a side of the rectangular ground loop 140, and $W_3$ indicates a width of a finger.

Optionally, each embedded interdigital structure 160 in the at least one embedded interdigital structure 160 may introduce a resonant frequency of the resonant unit 100 independently. This resonant frequency may also be referred to as a base frequency or a center frequency of the resonant unit 100. For example, the resonant frequency introduced by the embedded interdigital structure 160 may be referred to as a second base frequency ($f_{02}$) or a third base frequency ($f_{03}$).

Optionally, a value of the resonant frequency introduced by each embedded interdigital structure 160 may be determined by at least one of the parameters, a quantity of fingers in each embedded interdigital structure 160, a width of a finger in each embedded interdigital structure 160, or a length of a finger in each embedded interdigital structure 160. For example, as shown in FIG. 1A, the resonant frequency introduced by each embedded interdigital structure 160 may be reduced by increasing the quantity of fingers in each embedded interdigital structure 160, the width ($W_s$) of a finger, or the length ($L_s$) of a finger.

Optionally, as shown in FIG. 1B, values of resonant frequencies (for example, the $f_{01}$ and/or the $f_{02}$) may be trimmed by adjusting the width $W_t$ of the T-shaped horizontal end, the length $L_{t1}$ of the T-shaped horizontal end, and the length $L_{t2}$ of the T-shaped vertical end of the T-shaped microstrip. For example, values of base frequencies of the resonant unit 100 may be trimmed by adjusting lengths $L_{t1}$, $L_{t2}$, and $W_t$ of the T-shaped microstrip.

Optionally, the multiple embedded interdigital structures 160 in the resonant unit 100 may have different sizes. Therefore, multiple resonant points (namely, resonant frequencies) are introduced, and a slow-wave resonant unit 100 having multiple resonant points is formed. The resonant points introduced by the embedded interdigital structures 160 are independent of each other.

Figure 2:
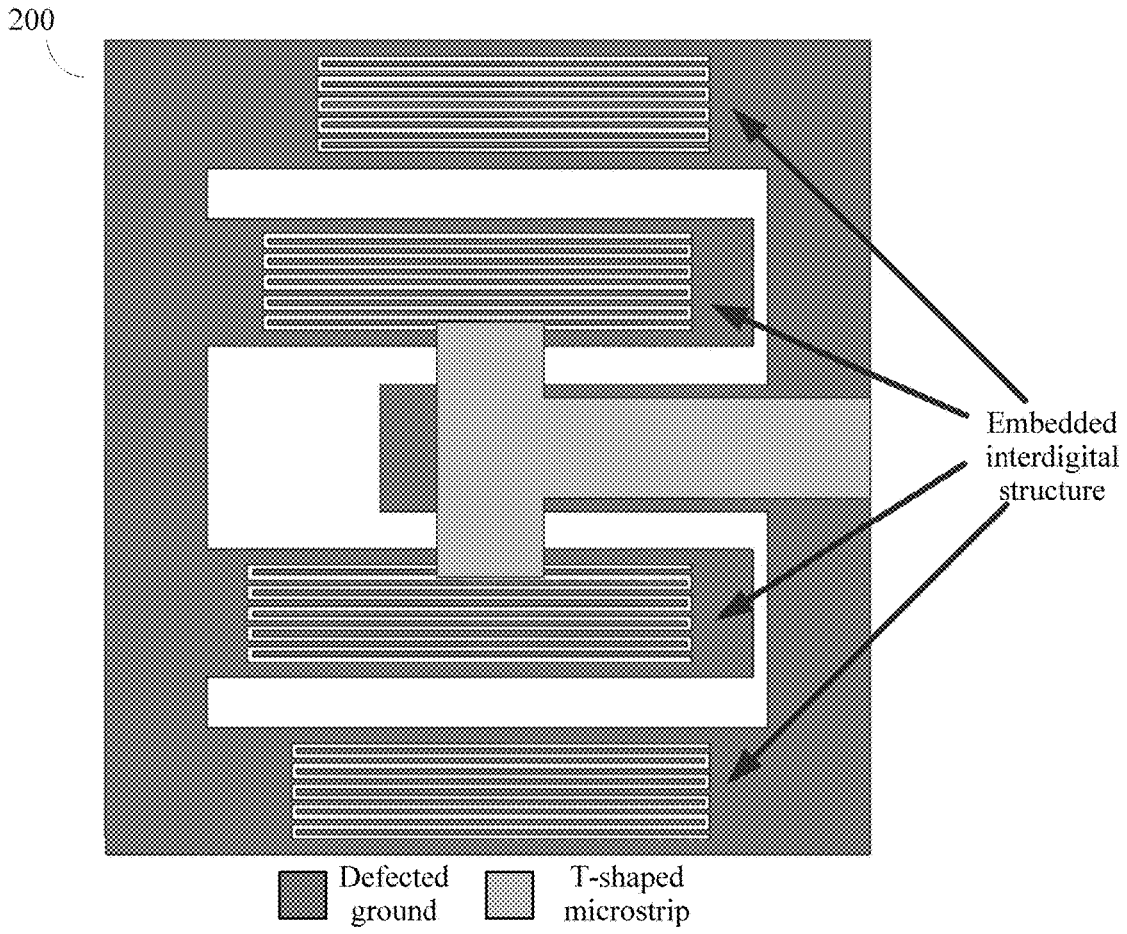
FIG. 2 is a schematic structural diagram of a resonant unit according to another embodiment of the present disclosure.
Figure 3:
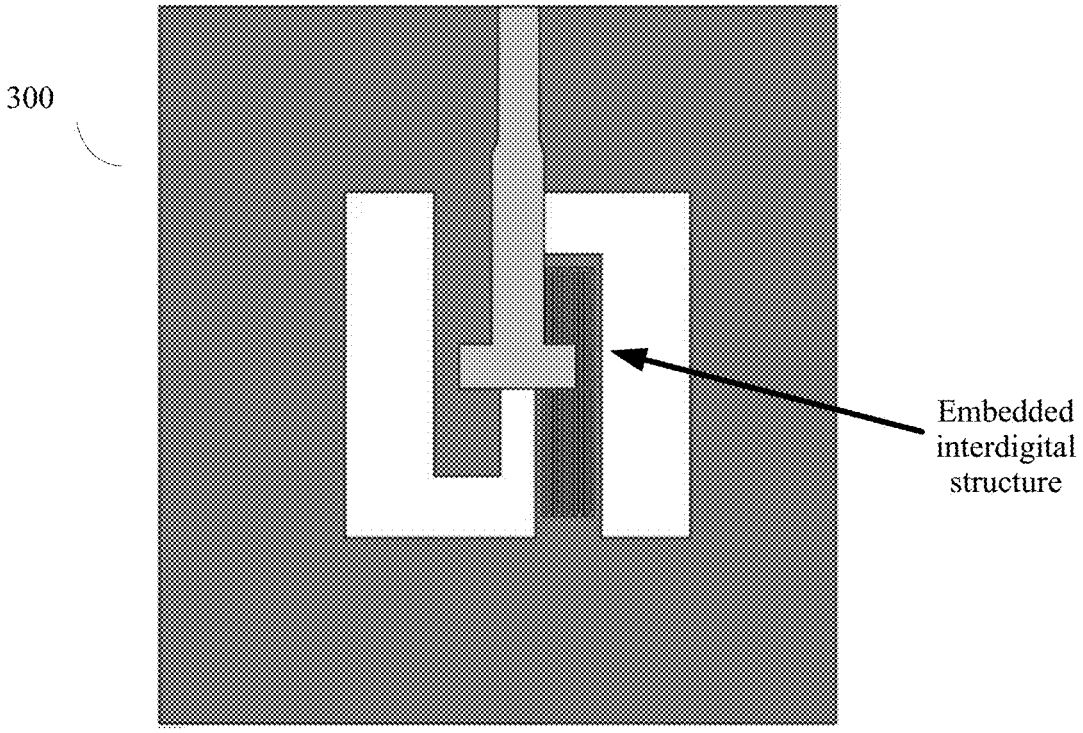
FIG. 3 is a schematic structural diagram of a resonant unit according to another embodiment of the present disclosure.
Figure 4:
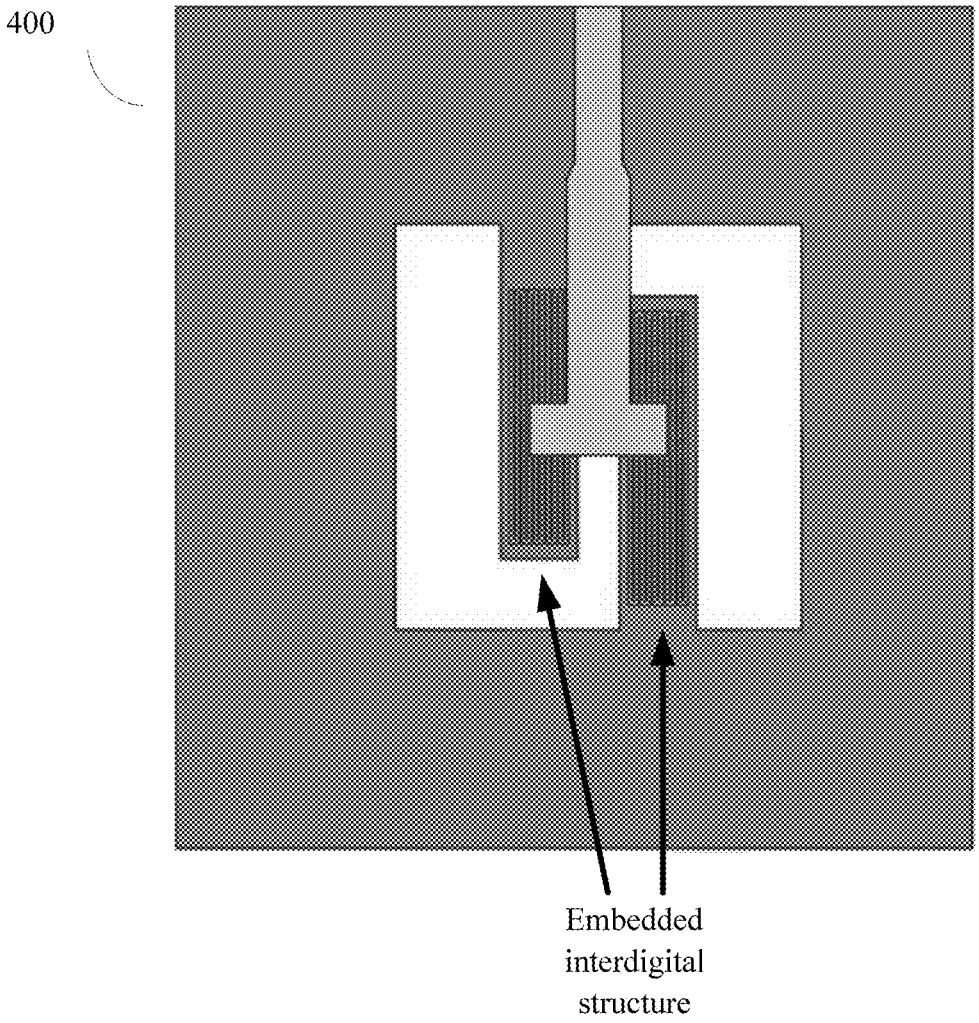
FIG. 4 is a schematic structural diagram of a resonant unit according to another embodiment of the present disclosure.

FIG. 2 to FIG. 4 show schematic structural diagrams of a resonant unit according to another embodiment of the present disclosure. A person skilled in the art can understand that, examples in FIG. 2 to FIG. 4 are merely intended to help a person skilled in the art understand this embodiment of the present disclosure, and this embodiment of the present disclosure is not limited to illustrated specific scenarios. Obviously, a person skilled in the art may make various equivalent modifications and variations according to the examples provided by the present disclosure. This embodiment of the present disclosure is intended to cover the modifications and variations.

As shown in FIG. 2 to FIG. 4, a quantity of fingers, and a quantity and locations of embedded interdigital structures in an interdigital structure in this embodiment of the present disclosure are not limited. An embedded interdigital structure may be located on each finger of the interdigital structure, or may be located on a finger of the interdigital structure, or may be located on a ground loop. For example, a resonant unit 200 shown in FIG. 2 includes four embedded interdigital structures, and the embedded interdigital structures may be located on a ground loop or two fingers in three fingers of an interdigital structure. A resonant unit 300 shown in FIG. 3 includes an embedded interdigital structure, and the embedded interdigital structure may be located on one finger in two fingers of an interdigital structure. Alternatively, as shown in FIG. 4, a resonant unit 400 includes two embedded interdigital structures, and the two embedded interdigital structures may be respectively located on two fingers included in the interdigital structure.

The foregoing describes resonant units according to the embodiments of the present disclosure with reference to FIG. 1A to FIG. 4. The following describes filters according to the embodiments of the present disclosure with reference to FIG. 5 to FIG. 10.

Figure 5A:
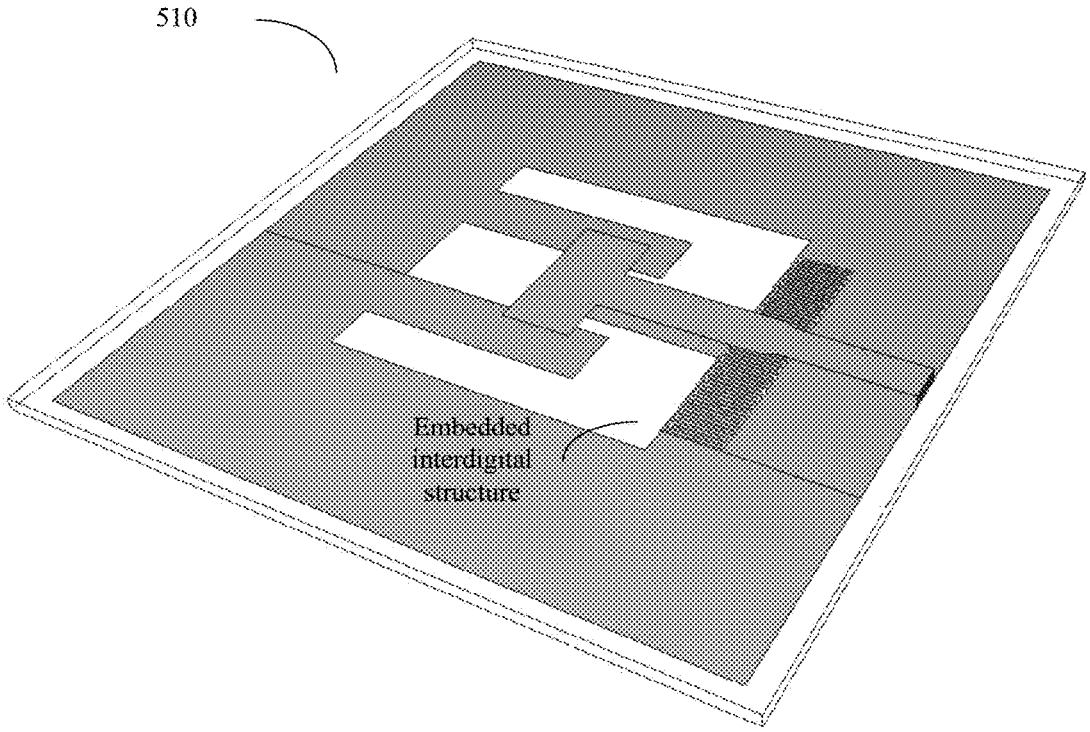
FIG. 5A is a schematic structural diagram of a resonant unit according to another embodiment of the present disclosure.
Figure 5B:
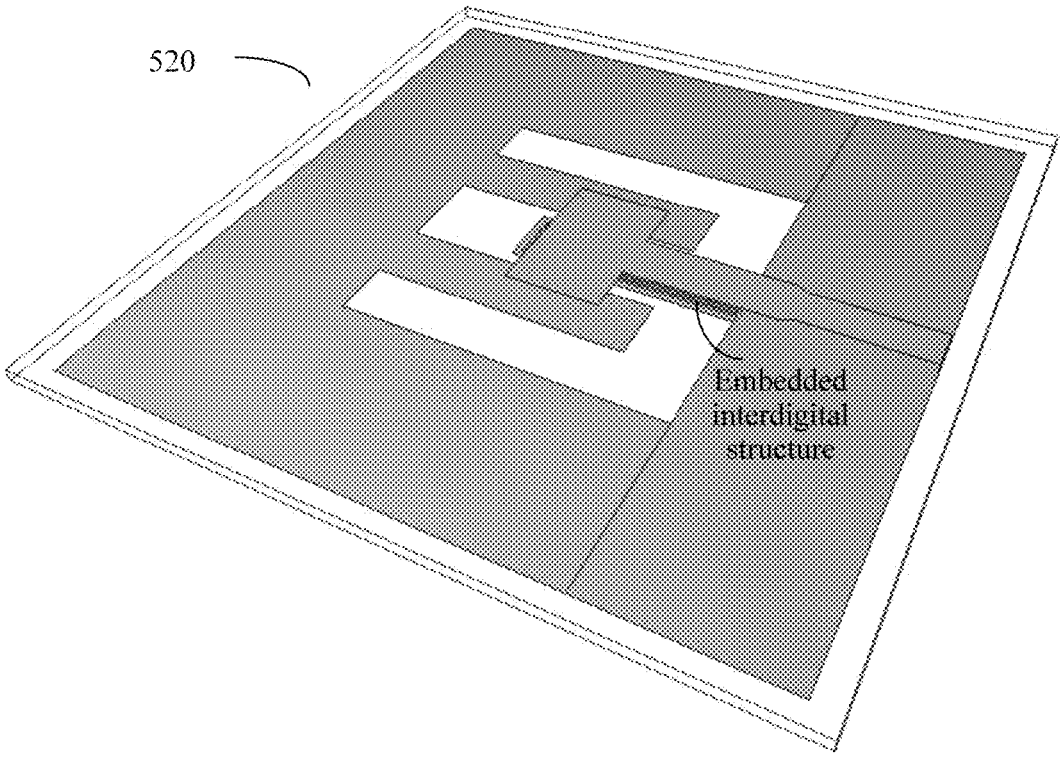
FIG. 5B is a schematic structural diagram of a resonant unit according to another embodiment of the present disclosure.

As described above, an embodiment of the present disclosure provides a filter including the foregoing resonant unit 100, 200, 300, and 400. The filter may be a band-pass filter, or may be a band-stop filter. Further, the filter may be a multi-passband band-pass filter, or may be a multi-stopband band-stop filter. For example, an embedded interdigital structure is disposed directly below a metal microstrip, and a band-stop filter may be formed. Furthermore, being directly below the metal microstrip may mean that the embedded interdigital structure is disposed in an area using a central axis of a projection of the metal microstrip (namely, a projection of the metal microstrip on a plane in which the defected ground structure is located) as a symmetry axis. A transmission zero may be introduced for the filter, that is, a band-stop filter is formed. For example, FIG. 5A and FIG. 5B show two manners of introducing a transmission zero for a filter. An embedded interdigital structure in a resonant unit 510 and a resonant unit 520 in FIG. 5A and FIG. 5B is symmetric along a central axis in an area covered by a projection of a T-shaped microstrip. Therefore, a transmission zero is introduced for a filter to form a band-stop filter. Correspondingly, as shown in FIG. 1A to FIG. 4, an embedded interdigital structure is disposed in another area not directly below a metal microstrip, and a band-pass filter may be formed. Using a band-pass filter as an example, the following describes a filter provided by an embodiment of the present disclosure.

In an embodiment of the present disclosure, an embedded interdigital structure is introduced in a defected ground structure in a resonant unit included in a filter. Therefore, a high-order harmonic wave in a base frequency signal is pushed to a higher frequency, a harmonic suppression capability of the filter is improved, the filter has a wide stopband with higher suppression, and an area of the filter is reduced.

Figure 6:
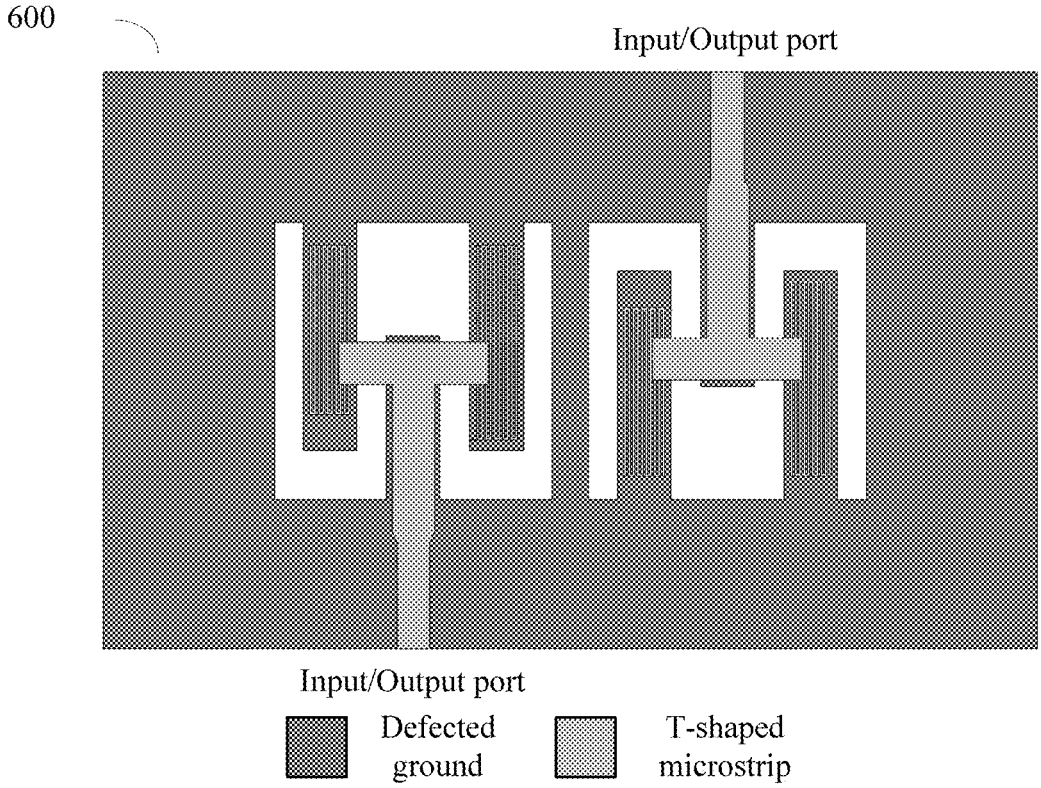
FIG. 6 is a schematic structural diagram of a filter according to an embodiment of the present disclosure.

FIG. 6 is a schematic diagram of a band-pass filter 600 according to an embodiment of the present disclosure. As shown in FIG. 6, a band-pass filter 600 may be formed by cascading at least two resonant units. For example, either of two resonant units introduced in FIG. 6 includes two embedded interdigital structures, that is, either of the two resonant units includes three resonant frequencies. The two resonant units having three resonant frequencies are cascaded, and a second-order three-passband band-pass filter 600 may be obtained. A metal microstrip of a resonant unit may be used as an input/output port of the band-pass filter 600. Theoretically, any multi-passband band-pass filter may be implemented. That is, at least two resonant units having N resonant frequencies are cascaded, and an N-passband band-pass filter may be obtained, where N is an integer greater than or equal to 1.

Figure 7:
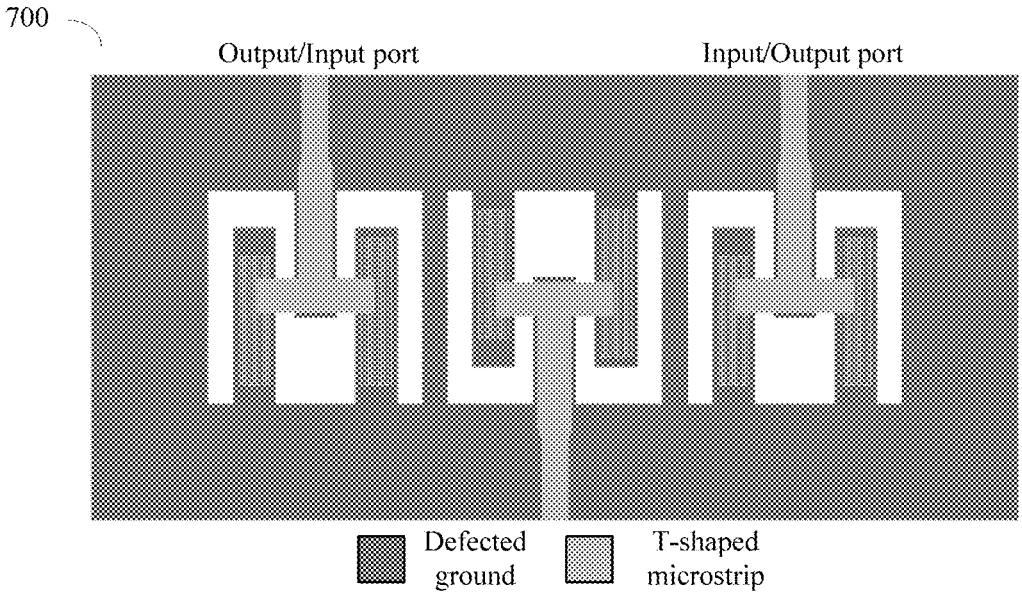
FIG. 7 is a schematic structural diagram of a filter according to another embodiment of the present disclosure.

Optionally, the resonant units included in the band-pass filter 600 may be extended by multi-level cascading such that an ultra wide stopband multi-order band-pass filter is obtained. By increasing a quantity of resonant units, stopband suppression performance of the filter is enhanced, and steepness of a passband is increased. For example, FIG. 7 shows a schematic diagram of a filter 700 according to another embodiment of the present disclosure. As shown in FIG. 7, three resonant units are cascaded, and a third-order band-pass filter (a third-order three-passband band-pass filter 700 shown in FIG. 7) may be obtained. Optionally, the cascading manner may be applied to cascading of any plurality of resonant units having any plurality of frequencies.

Optionally, the resonant units in the filter may be cascaded in a manner of magnetic coupling cascading, electric coupling cascading, or through-hole cascading. The magnetic coupling cascading manner is shown in a filter 800 in FIG. 8. Resonant units are cascaded by means of direct connection (as shown by a dashed line in FIG. 8). The electric coupling cascading manner is shown in a filter 900 in FIG. 9. That is, resonant units are not directly connected to each other. A broadside couple manner (as shown by a dashed line in the FIG. 9) is used instead. Alternatively, resonant units are cascaded by means of through-hole connection. As shown in a filter 1000 in FIG. 10, on a basis of broadside couple, a through-hole is added in an overlapping part of the resonant units (as shown by a dashed line in the FIG. 10), and coupling intensity is increased by means of mixed coupling. Optionally, the three cascading manners may be applicable to connecting any plurality of resonant units, and may be mixed in use.

Figure 8:
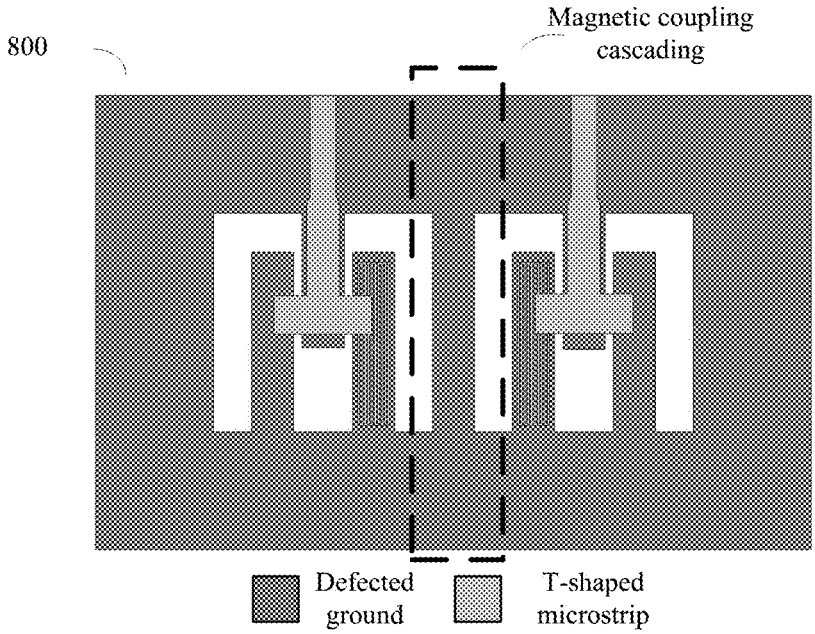
FIG. 8 is a schematic structural diagram of a filter according to another embodiment of the present disclosure.
Figure 9:
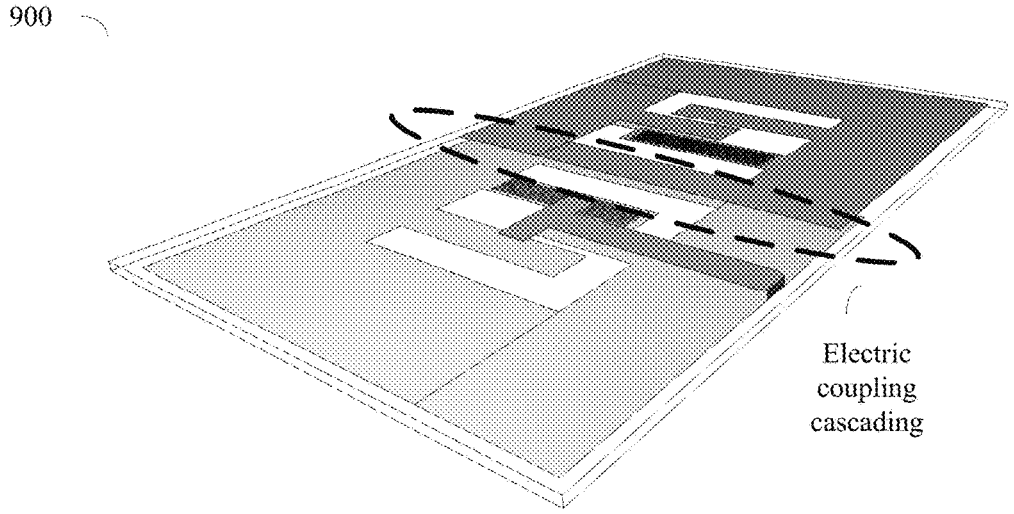
FIG. 9 is a schematic structural diagram of a filter according to another embodiment of the present disclosure.
Figure 10:
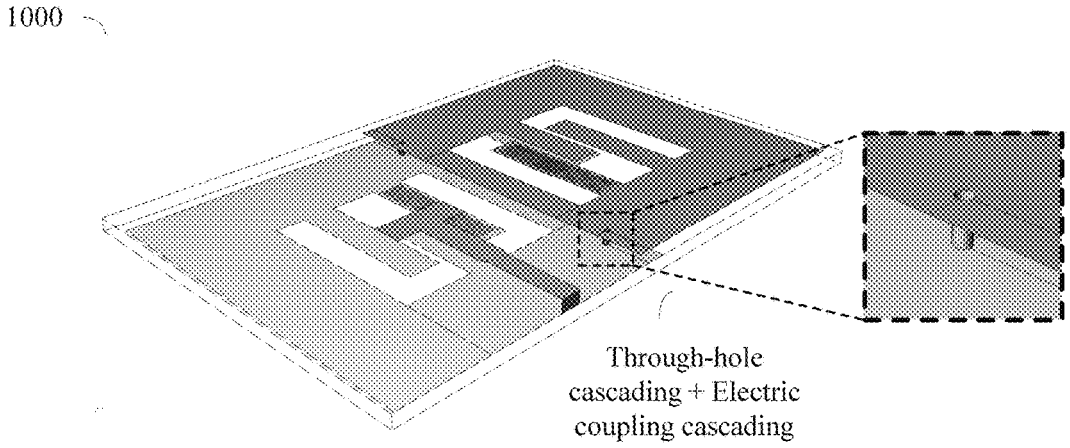
FIG. 10 is a schematic structural diagram of a filter according to another embodiment of the present disclosure.

Optionally, metal microstrips of multiple cascaded resonant units may be used as input/output ports of a filter, and may be located on a same side of the resonant units (as shown in FIG. 8), or may be located on different sides of the resonant units (as shown in FIG. 6). This is not limited in this embodiment of the present disclosure.

Figure 11:
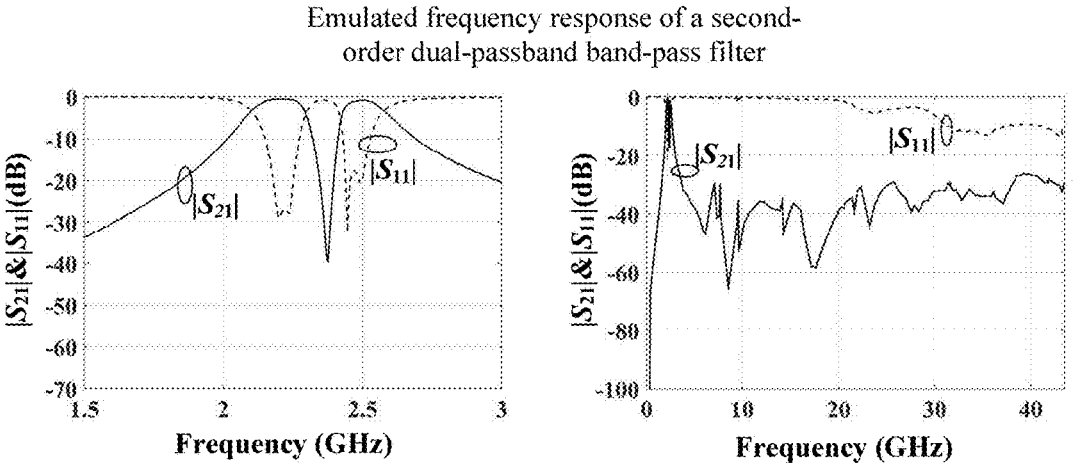
FIG. 11 shows an emulation result of a filter according to an embodiment of the present disclosure.
Figure 12:
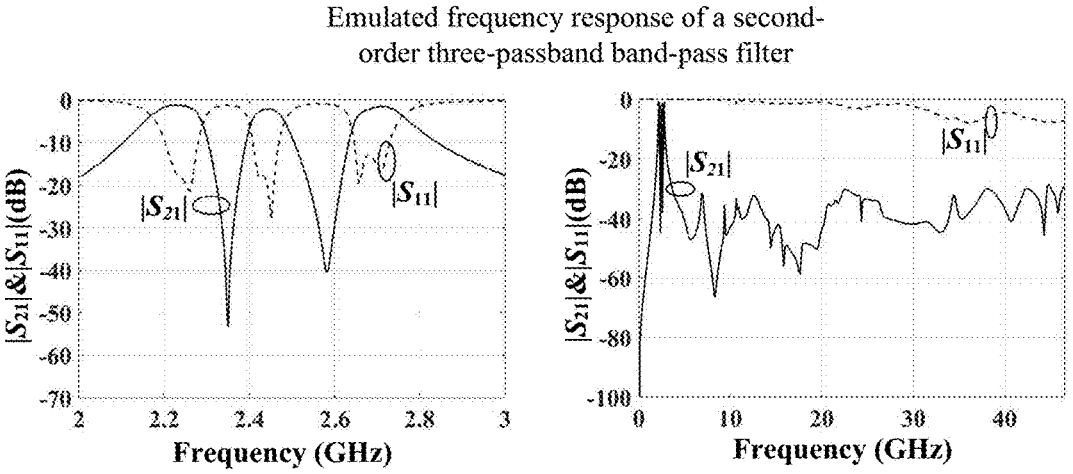
FIG. 12 shows an emulation result of a filter according to another embodiment of the present disclosure.
Figure 13:
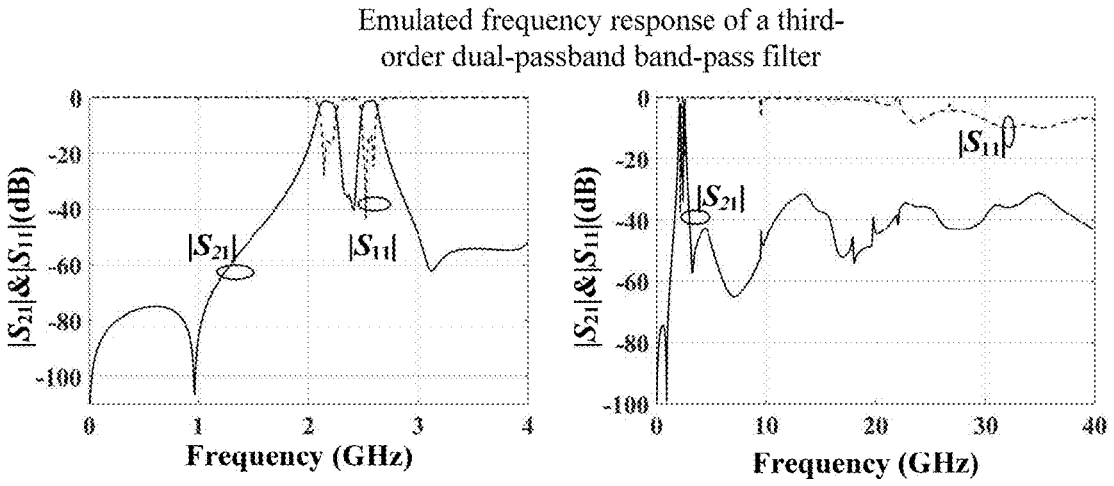
FIG. 13 shows an emulation result of a filter according to another embodiment of the present disclosure.

FIG. 11 to FIG. 13 show emulation results of filters according to the embodiments of the present disclosure. A person skilled in the art can understand that, in FIG. 11 to FIG. 13, S21 and S11 indicate S parameters, S21 indicates a transmission factor from a port 2 (output port) to a port 1 (input port), and S11 indicates a reflection factor seen from the port 1. The two parameters are both greater than 0 but are not greater than 1, and are generally measured in decibel (dB). Greater S21 indicates that more energy is transmitted from the port 1 to the port 2. Greater S11 indicates that most of energy input from the port 1 is reflected back and does not arrive at the port 2. Therefore, for a passband of a filter, S21 is great, but S11 is small, and if S21 is closer to 0 dB, it indicates that an energy loss in a transmission process is smaller. For a stopband of a filter, S21 is small, but S11 is great, and if S21 is smaller, it indicates that stopband suppression is better.

FIG. 11 shows an emulation result of a second-order dual-passband band-pass filter. This filter is formed by cascading two resonant units having two resonant frequencies. As can be known from FIG. 11, the resonant frequencies of the filter are respectively 2.21 gigahertz (GHz) and 2.47 GHz, a spacing between resonant frequencies of passbands is 260 megahertz (MHz), a stopband may be extended to 19.7 times that of an $f_{01}$ (2.21 GHz) or 17.6 times that of an $f_{02}$ (2.47 GHz), and suppression reaches −26.3 dB. FIG. 12 shows an emulation result of a second-order three-passband band-pass filter. This filter is formed by cascading two resonant units having three resonant frequencies. As can be known from FIG. 12, the resonant frequencies of the filter are respectively 2.24 GHz, 2.44 GHz, and 2.69 GHz, spacings between resonant frequencies of adjacent channels are respectively 200 MHz and 250 MHz, a stopband may be extended to 20.7 times that of an $f_{01}$ (2.24 GHz), 19.1 times that of an $f_{02}$ (2.44 GHz), or 17.3 times that of a $f_{03}$ (2.69 GHz), and suppression reaches −28.6 dB. As can be known from the emulation results shown in FIG. 11 and FIG. 12, the filters provided by the embodiments of the present disclosure have high out-band suppression capabilities and small spacings between resonant frequencies, and may be applicable to more scenarios.

FIG. 13 shows an emulation result of a third-order dual-passband band-pass filter. This filter is formed by cascading three resonant units having two resonant frequencies. As can be known from FIG. 13, the resonant frequencies of the filter are respectively 2.16 GHz and 2.52 GHz, a spacing between resonant frequencies of passbands is 360 MHz, a stopband may be extended to 18.5 times that of an $f_{01}$ (2.16 GHz) or 15.9 times that of an $f_{02}$ (2.52 GHz), and suppression reaches −31.5 dB. It can be seen that, in comparison with the second-order dual-passband band-pass filter in FIG. 12, due to an increase of cascaded resonant units, the third-order dual-passband band-pass filter has higher suppression.

It can be known from FIG. 11 to FIG. 13 that, the filters in the embodiments of the present disclosure can improve filter out-band suppression capabilities.

In addition, the terms "system" and "network" may be used interchangeably in this specification. The term "and/or" in this specification describes only an association relationship for describing associated objects and represents that three relationships may exist. For example, A and/or B may represent the following three cases. Only A exists, both A and B exist, and only B exists. In addition, the character "/" in this specification generally indicates an "or" relationship between the associated objects. The input/output port may be used as an input port or an output port, or may be simultaneously used as an input and output port. In the filters 600, 700, 800, 900, 1000 in FIG. 5 to FIG. 10, when multiple resonant units are cascaded, an input/output port of any resonant unit may be used as a signal input port, and an input/output port of another resonant unit may be used as a signal output port.

To make the application document brief and clear, the foregoing technical features and descriptions in an embodiment may be understood as applicable to other embodiments, and details are not described again in the other embodiments. The foregoing descriptions are merely specific embodiments of the present disclosure, but are not intended to limit the protection scope of the present disclosure. Any modification or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A resonant unit, comprising:

a dielectric substrate;

an input/output port including a metal microstrip disposed on a first side of the dielectric substrate; and a defected ground structure disposed on a second side of the dielectric substrate that is opposite the first side of the dielectric substrate, the defected ground structure comprising a ground loop and an interdigital structure located inside the ground loop, the interdigital structure comprising a plurality of fingers, and at least one finger of the plurality of fingers of the interdigital structure comprising at least one embedded interdigital structure embedded within the at least one finger.

2. The resonant unit of claim 1, wherein each embedded interdigital structure of the at least one embedded interdigital structure introduces a respective resonant frequency of the resonant unit.

3. The resonant unit of claim 2, wherein a value of the respective resonant frequency introduced by each respective embedded interdigital structure of the at least one embedded interdigital structure is determined by at least one of the following parameters:

a quantity of fingers of the respective embedded interdigital structure;

a width of a finger in the respective embedded interdigital structure; or a length of a finger in the respective embedded interdigital structure.

4. The resonant unit of claim 1, wherein a number of the plurality of fingers is three fingers, and at least a part of the at least one embedded interdigital structure is located on at least one of the three fingers.

5. The resonant unit of claim 1, wherein a number of the plurality of fingers is two fingers, and at least a part of the at least one embedded interdigital structure is located on at least one of the two fingers.

6. The resonant unit of claim 1, wherein the metal microstrip is a T-shaped microstrip.

7. The resonant unit of claim 6, wherein the T-shaped microstrip includes a T-shaped horizontal end and a T-shaped vertical end, a projection of the T-shaped horizontal end on the first side of the dielectric substrate overlaps at least a part of the plurality of fingers, and a projection of the T-shaped vertical end on the second side of the dielectric substrate overlaps one finger of the plurality of fingers.

8. The resonant unit of claim 7, wherein the projection of the T-shaped horizontal end on the first side of the dielectric substrate overlaps all of the plurality of fingers.

9. A filter, comprising:

at least two cascaded resonant units, each of the at least two cascaded resonant units comprising:

a dielectric substrate;

a signal input/output port including a metal microstrip disposed on a first side of the dielectric substrate; and a defected ground structure disposed on a second side of the dielectric substrate opposite the first side of the dielectric substrate, the defected ground structure comprising a ground loop and an interdigital structure located inside the ground loop, the interdigital structure comprising a plurality of fingers, and at least one finger of the plurality of fingers of the interdigital structure comprising at least one embedded interdigital structure embedded within the at least one finger.

10. The filter of claim 9, wherein the at least two cascaded resonant units are cascaded in at least one of the following manners:

through-hole cascading;

electric coupling cascading; or magnetic coupling cascading.

11. The filter of claim 9, wherein structures of the at least two cascaded resonant units are the same.

12. The filter of claim 9, wherein, for each of the at least two cascaded resonant units, each embedded interdigital structure of the at least one embedded interdigital structure of the cascaded resonant unit introduces a respective resonant frequency of the cascaded resonant unit.

13. The filter of claim 12, wherein, for each of the at least two cascaded resonant units, a value of the respective resonant frequency introduced by each respective embedded interdigital structure of the at least one embedded interdigital structure of the cascaded resonant unit is determined by at least one of the following parameters:

a quantity of fingers in the respective embedded interdigital structure;

a width of a finger in the respective embedded interdigital structure; or a length of a finger in the respective embedded interdigital structure.

14. The filter of claim 9, wherein, for each of the at least two cascaded resonant units, a number of the plurality of fingers of the cascaded resonant unit is three fingers, and at least a part of the at least one embedded interdigital structure of the cascaded resonant unit is located on at least one of the three fingers of the cascaded resonant unit.

15. The filter of claim 9, wherein, for each of the at least two cascaded resonant units, a number of the plurality of fingers of the cascaded resonant unit is two fingers, and at least a part of the at least one embedded interdigital structure of the cascaded resonant unit is located on at least one of the two fingers of the cascaded resonant unit.

16. The filter of claim 9, wherein, for each of the at least two cascaded resonant units, the metal microstrip of the cascaded resonant unit is a T-shaped microstrip.

17. The filter of claim 16, wherein, for each of the at least two cascaded resonant units, the T-shaped microstrip of the cascaded resonant unit includes a T-shaped horizontal end and a T-shaped vertical end, a projection of the T-shaped horizontal end of the T-shaped microstrip of the cascaded resonant unit on the first side of the dielectric substrate of the cascaded resonant unit overlaps at least a part of the plurality of fingers of the cascaded resonant unit, and a projection of the T-shaped vertical end of the T-shaped microstrip of the cascaded resonant unit on the first side of the dielectric substrate of the cascaded resonant unit overlaps one finger of the plurality of fingers of the cascaded resonant unit.

18. The filter of claim 17, wherein, for each of the at least two cascaded resonant units, the projection of the T-shaped horizontal end of the T-shaped microstrip of the cascaded resonant unit on the first side of the dielectric substrate of the cascaded resonant unit overlaps all of the plurality of fingers of the cascaded resonant unit.

19. A communications system, comprising:

a filter comprising at least two cascaded resonant units, each of the at least two cascaded resonant units comprising:

a dielectric substrate;

a signal input/output port including a metal microstrip disposed on a first side of the dielectric substrate; and a defected ground structure disposed on a second side of the dielectric substrate opposite the first side of the dielectric substrate, the defected ground structure comprising a ground loop and an interdigital structure located inside the ground loop, the interdigital structure comprising a plurality of fingers, and at least one finger in the interdigital structure comprising at least one embedded interdigital structure embedded within the at least one finger.

20. The communications system of claim 19, wherein the at least two cascaded resonant units are cascaded in at least one of the following manners:

through-hole cascading;

electric coupling cascading; or magnetic coupling cascading.

* * * * *